US007029571B1

(12) United States Patent
Bhattacharyya et al.

(10) Patent No.: US 7,029,571 B1
(45) Date of Patent: Apr. 18, 2006

(54) MULTI STAGE SELECTIVE CATALYTIC CRACKING PROCESS AND A SYSTEM FOR PRODUCING HIGH YIELD OF MIDDLE DISTILLATE PRODUCTS FROM HEAVY HYDROCARBON FEEDSTOCKS

(75) Inventors: Debasis Bhattacharyya, Haryana (IN); Asit Kumar Das, Haryana (IN); Arumugam Velayutham Karthikeyani, Haryana (IN); Satyen Kumar Das, Haryana (IN); Pankaj Kasliwal, Haryana (IN); Manoranjan Santra, Haryana (IN); Latoor Lal Saroya, Haryana (IN); Jagdev Kumar Dixit, Haryana (IN); Ganga Sanker Mishra, Haryana (IN); Jai Prakash Singh, Haryana (IN); Satish Makhija, New Delhi (IN); Sobhan Ghosh, Haryana (IN)

(73) Assignee: Indian Oil Corporation Limited, Bander (East) Mumbai (IN)

( * ) Notice: Subject to any disclaimer, the term of this patent is extended or adjusted under 35 U.S.C. 154(b) by 0 days.

(21) Appl. No.: 09/937,850

(22) PCT Filed: Feb. 16, 2000

(86) PCT No.: PCT/IN00/00013

§ 371 (c)(1),
(2), (4) Date: Jul. 30, 2002

(87) PCT Pub. No.: WO01/60951

PCT Pub. Date: Aug. 23, 2001

(51) Int. Cl.
*C10G 51/02* (2006.01)
*B01J 8/08* (2006.01)

(52) U.S. Cl. ..... 208/76; 208/75; 208/77; 208/78; 422/141; 422/145; 422/190; 422/214

(58) Field of Classification Search ..... 208/75, 208/77, 78, 76; 422/141, 145, 190, 214
See application file for complete search history.

(56) References Cited

U.S. PATENT DOCUMENTS

| | | | | |
|---|---|---|---|---|
| 3,891,540 | A * | 6/1975 | Demmel et al. | 208/77 |
| 3,894,931 | A | 7/1975 | Nace et al. | |
| 3,894,933 | A | 7/1975 | Owen et al. | |
| 3,928,172 | A | 12/1975 | Davis, Jr. et al. | |
| 4,388,175 | A * | 6/1983 | Lionetti et al. | 208/74 |
| 4,436,613 | A | 3/1984 | Sayles et al. | |
| 4,481,104 | A | 11/1984 | Walsh | |
| 4,606,810 | A | 8/1986 | Krambeck et al. | |
| 4,830,728 | A | 5/1989 | Herbst et al. | |

(Continued)

FOREIGN PATENT DOCUMENTS

| | | |
|---|---|---|
| EP | 0142900 | 5/1985 |

(Continued)

*Primary Examiner*—Walter D. Griffin
(74) *Attorney, Agent, or Firm*—Lowe Hauptman & Berner LLP

(57) ABSTRACT

According to this invention, there is provided a process and apparatus for catalytic cracking of various petroleum based heavy feed stocks in the presence of solid zeolite catalyst and high pore size acidic components for selective bottom cracking and mixtures thereof, in multiple riser type continuously circulating fluidized bed reactors operated at different severities to produce high yield of middle distillates, in the range of 50–65 wt % of fresh feed.

22 Claims, 4 Drawing Sheets

U.S. PATENT DOCUMENTS 4,874,503 A * 10/1989 Herbst et al. ..... 208/67
5,098,554 A 3/1992 Krishna et al.
5,401,387 A 3/1995 Harandi et al.
5,824,208 A 10/1998 Bienstock et al.
5,944,982 A * 8/1999 Lomas ..... 208/164

FOREIGN PATENT DOCUMENTS

WO 99/41331 8/1999

* cited by examiner

MULTI STAGE SELECTIVE CATALYTIC CRACKING PROCESS AND A SYSTEM FOR PRODUCING HIGH YIELD OF MIDDLE DISTILLATE PRODUCTS FROM HEAVY HYDROCARBON FEEDSTOCKS

FIELD OF THE INVENTION

This invention relates to a process and a system for the improved production of middle distillate products comprising hydrocarbons having carbon atoms in the range of $C_8$ to $C_{24}$ in high yield, from heavier petroleum fractions through multistage catalytic cracking of varying severity levels with solid acidic catalyst without using external hydrogen.

BACKGROUND OF THE INVENTION

Conventionally, middle distillate range products, e.g. heavy naphtha, kerosene, jet fuel, diesel oil and light cycle oil (LCO), are produced in petroleum refineries by atmospheric/vacuum distillation of petroleum crude and also by the secondary processing of vacuum gas oil and residues or mixtures thereof. Most commonly practiced commercial secondary processes are Fluid Catalytic Cracking (FCC) and Hydrocracking. Hydrocracking employs porous acidic catalysts similar to those used in catalytic cracking but associated with hydrogenation components such as metals of Groups VI and VII of the Periodic Table to produce good quality of middle distillate products in the boiling range of $C_8$–$C_{24}$ hydrocarbons. An excess of hydrogen is supplied to the hydrocracking reactor under very high pressure (150–200 atm.) and at a relatively lower temperature (375–425° C.) in fixed bed reactors with two phase flow. Due to severe hydrogenation, all hydrocarbon products from Hydrocracker are highly saturated with low sulfur and aromaticity. The yield of middle distillate hydrocarbons (126–391° C. boiling range) in hydrocracking is typically very high, i.e. up to 65–80 wt % of feed.

FCC process, on the other hand, is employed for producing substantial quantities of high octane gasoline and LPG. In countries where demand for middle distillate product is higher, heavy cracked naphtha (HCN: $C_8$–$C_{12}$ hydrocarbons) and light cycle oil (LCO: $C_{13}$–$C_{24}$ hydrocarbons) production are maximized by manipulating operating variables so as to vary the reaction and regenerator severity levels. U.S. Pat. Nos. 3,894,931 and 3,894,933 address such operations. Typically, diesel yield in FCC is maximized by maintaining a lower reaction and regeneration severity and recycling of unconverted residual products. Catalysts with lower zeolite/matrix ratio and MAT (Micro Activity Test) activity of about 60–70 is normally preferred. By proper selection of FCC variables and innovations involving catalyst type and recycle of heavy cycle oil and residual slurry oil, distillate yield can be increased by considerable amount at the expense of Gasoline yield. As the FCC unit operation is shifted from gasoline mode to middle distillate maximization mode, the LCO cetane number increases and thus could be more useful for blending into the diesel pool.

However, while running at low severity operations for maximizing diesel yield, the unconverted bottom yield also increases to a significant extent and sometimes may even exceed 20 wt % of fresh feed, as against 5–6 wt % for the usual gasoline mode operation. The other drawback of low severity operation is in the high amount of recycle oil being fed to the bottom of the riser with fresh feed for further cracking. Firstly, this reduces the throughput of riser reactor and secondly, with a single riser and product fractionator, the recycle is nonselective. Consequently, diesel yield from FCC with a conventional cracking catalyst could be maximized up to 40–45 wt % in spite of running at low reaction severity (495° C. riser temperature) and fairly high recycle ratio (30% of fresh feed).

Besides the operation of conventional FCC in middle distillate maximization mode, there are several other processes aiming for improvement in middle distillate yield. U.S. Pat. No. 5,098,554 discloses a process of fluid catalytic cracking with multiple feed injection points where fresh feed is charged to upper injection points and unconverted slurry oil is recycled to a location below the fresh feed nozzles. Essentially, the process conditions are similar to that of gasoline mode FCC operation (e.g., 527° C. riser top temperature) which favors gasoline production. By adopting split feed injection, middle distillate yield is marginally increased at the expense of gasoline yield.

U.S. Pat. No. 4,481,104 describes about an ultra-stable Y-zeolite, of high framework silica to alumina ratio having low acidity and large pores, use of which in catalytic cracking of gas oil, enhances distillate yield. It may be noted that yield of 420–650° F. fraction is maximize about 28 wt % of feed and, as 650° F.– conversion increases beyond 67 wt %, the yield of 420–650° F. fraction reduces. Therefore, as discussed earlier, yield of the distillate is relatively higher only at the higher yield of unconverted fraction.

Yet another process, reported in U.S. Pat. No. 4,606,810, discloses a scheme of two riser cracking for improving total gasoline plus distillate yield. Here, the feed is first cracked in the first riser with spent catalyst from the second riser and the unconverted part is further cracked in a second riser in presence of regenerated catalyst. The basic operation is of high severity producing maximum amount of gasoline and the yield of LFO is around 15–20 wt % of feed. It may also be noted that while increase in gasoline yield is in the range of 7.5–8.0 wt %, increase in LFO yield is merely in the range of 1.5–3.0 wt % on fresh feed basis.

Two stage processing of hydrocarbon feedstock has been employed by different researchers in the field of catalytic cracking. Several processes have been developed in which first stage processing removes metals and Conradson Carbon Residue (CCR) impurities from feed using a low activity cheap contact material with abundant surface area. The demetallized feed is then processed in a more conventional second stage reactor under high severity conditions to maximize the conversion and gasoline production. U.S. Pat. No. 4,436,613 describes such a process of two stage catalytic cracking using two different types of catalyst. In the first stage, the CCR materials and metals are separated from the rest of the feedstock along with mild cracking over a relatively lower activity catalyst. The residual un-cracked product of the first stage is then contacted with a high activity catalyst under higher reaction severity for gasoline maximization. It may be noted that in this process, two dedicated strippers and regenerators are used to avoid the mixing of two different types of catalysts.

Dual riser high severity catalytic cracking process described in U.S. Pat. No. 3,928,172 utilizes a mixture of large pore REY zeolite catalyst and a shape selective zeolite catalyst where gas oil is cracked in the first riser in the presence of the aforesaid catalyst mixture. The heavy naphtha product from the first riser and/or virgin straight run naphtha are cracked in the second riser in the presence of catalyst mixture to produce high octane gasoline together with $C_3$ and $C_4$ olefins. U.S. Pat. No. 4,830,728 discloses a process for upgrading straight run naphtha, catalytically cracked naphtha and mixtures thereof in a multiple fluid catalytic cracking operation utilizing mixture of amorphous cracking catalyst and/or large pore Y-zeolite based catalyst and shape selective ZSM-5 zeolite catalyst to produce high octane gasoline.

U.S. Pat. No. 5,401,387 describes a process of multistage catalytic cracking where the first stage cracks a first feed over a shape selective zeolite to produce lighter products rich in iso-compounds which may be used for making ethers. A second feed, which may include 700° F.+ liquid from first stage, is cracked in the second stage. Another process, as described in U.S. Pat. No. 5,824,208, discloses a scheme in which hydrocarbon is initially contacted with cracking catalyst forming a first cracked product which, after recovering of the product fraction having boiling point of more than 430° F., is subjected to cracking in a second riser. The basic objective of this invention is to maximize the yield of light olefins and minimize the formation of aromatic compounds by avoiding undesirable hydrogen transfer reactions.

So far, most of the prior art methods have concentrated on multiple riser catalytic cracking for maximization of gasoline yield and its octane numbers, increased yield of iso-olefin for production of ethers, increased yield of light olefins, etc. From the prior art information and also from our experience of operating low severity FCC units, it is quite clear that maximizing middle distillate yield in FCC (without using external hydrogen) is not achieved beyond a level of 40–45 wt % of fresh feed. Further, persons involved in fluid catalytic cracking would be aware that middle distillate, being an intermediate product in the complex catalytic cracking reactions, is very difficult to maximize because, when the severity is increased, it is over cracked to lighter hydrocarbons.

Objects

Accordingly, one object of the present invention aims to propose a novel catalytic cracking process for producing middle distillate products in very high yield (about 50–65 wt %).

Another object is to provide a multiple riser system that enables the production of middle distillate products, including heavy naphtha and light cycle oil in high yield.

Yet another object of the invention is to provide a multiple riser system to produce higher yield of heavy naphtha and light Cycle Oil as compared to the prior art processes employing catalytic cracking of petroleum feedstock without any use of external supply of hydrogen.

A further objective of the process is to minimize the yield of unwanted dry gas and coke and also the yield of unconverted bottom products, at the same time, improving the cetane quality of the middle distillate product.

BRIEF SUMMARY OF THE INVENTION

According to the present invention, there is provided a novel process for catalytic cracking of various petroleum based heavy feed stocks in the presence of a solid zeolite catalyst and large pore size acidic components for selective bottom cracking and mixtures thereof, in a multiple riser type system wherein continuously circulating fluidized bed riser reactors are operated at different severities to produce middle distillate products in high yield, that is in the range of about 50–65 wt % of fresh feed.

The invention also provides an improved system for catalytic cracking of heavy feed stock to obtain middle distillate products in high yield, employing the process herein described.

DETAILED DESCRIPTION OF THE INVENTION

The invention relates to a multi stage selective catalytic cracking process for producing high yield of middle distillate products having an average number of carbon atoms in the range of about $C_8$ to $C_{24}$, from heavy hydrocarbon feedstock, in the absence of added hydrogen, said process comprising the steps of:

i) contacting preheated feed with a mixed catalyst in a first riser reactor, under catalytic cracking conditions including catalyst to oil ratio of about 2 to 8, WHSV of about 150–350 $hr^{-1}$, contact period of about 1 to 8 seconds and temperature in the range of about 400° C. to 500° C., to obtain first cracked hydrocarbon products;

ii) separating the first cracked hydrocarbon products from the first riser reactor into a first fraction comprising hydrocarbons with boiling points less than or equal to about 370° C. and a second fraction comprising hydrocarbons with boiling points greater than or equal to 370° C. that comprise unconverted feed material;

iii) cracking the second fraction from the first riser reactor, comprising hydrocarbons having boiling points greater than or equal to 370° C., in the presence of regenerated catalyst, in a second riser reactor operating under catalytic cracking conditions, including WHSV of about 75–275 $hr^{-1}$, catalyst to oil ratio of about 4–12 and riser top temperature of about 425–525° C. to obtain second cracked hydrocarbon products;

iv) separating the catalytically cracked products from the second riser reactor, along with cracked products comprising hydrocarbons having boiling points less than equal to 370° C., from the first riser reactor, in a main fractionating column to yield cracked products comprising dry gas, LPG, gasoline, middle distillates, heavy cycle oil and slurry oil;

v) recycling the entire heavy cycle oil, comprising hydrocarbons having boiling points in the range of about 370° C. to 450° C., and full or part of the slurry oil, having boiling points greater than or equal to about 450° C., into the second riser reactor at a vertically displaced position lower than the position of introduction of the main feed, comprising a bottom fraction comprising an unconverted hydrocarbon fraction, having boiling points greater than or equal to about 370° C., from the first riser reactor to obtain middle distillate products comprising hydrocarbons having carbon atoms in the range of about $C_8$–$C_{24}$ ranging from about 50 to 65 wt % of the fresh feed into the first riser.

iv) Optionally, recycling the fraction of unconverted hydrocarbons with boiling points greater than or equal to about 370° C., obtained in step (v), in riser reactor(s) by repeating steps (iii) to (iv), to obtain substantially pure middle distillate products.

In an embodiment, the feed stock is selected from petroleum based heavy feed stock, such as vacuum gas oil (VGO), visbreaker/cooker heavy gas oil, cooker fuel oil, hydrocracker bottoms, etc.

In another embodiment, mixed catalyst is obtained from an intermediate vessel used for mixing the spent catalyst from the common stripper, or preferably from a first stripper, with the regenerated catalyst from the common regenerator and charging the mixed catalyst, with coke content in the range of about 0.2 to 0.8 wt % to the bottom of the first riser at a temperature of 450–575° C.

In another embodiment, the exit hydrocarbon vapors from the first and second risers are quickly separated from respective spent catalysts using respective cyclones and/or other conventional separating devices to minimize the overcracking of middle distillate range products into less desirable lighter hydrocarbons.

In yet another embodiment, the spent catalysts from the first and second riser reactors are passed through respective dedicated catalyst strippers or a common stripper to render the catalysts substantially free of entrained hydrocarbons.

In a further embodiment, the regenerated catalyst with coke content of less than 0.4 wt % is obtained by burning a portion of the spent catalyst from the first stripper, the spent catalyst from the second stripper or the common stripper in a turbulent or fast fluidized bed regenerator in the presence of air or oxygen containing gases at a temperature ranging from about 600° C. to 750° C.

In another embodiment, the catalyst circulation between the fluidized bed riser reactors, strippers and the common regenerator is continuously through standpipe and slide valves.

In yet another embodiment, the critical catalytic cracking conditions in the first reactor, including mixed regenerated catalyst, result in very high selectivity of middle distillate range products and conversion of hydrocarbon products of boiling point less than or equal to 370° C. at lower than 50 wt % of the fresh feed.

In another embodiment, the zeolite cracking catalyst comprises commercial ReUSY zeolite based catalyst, having a fresh surface area of about 110–180 $m^2$/gm., a pore volume of about 0.25–0.38 cc/gm and an average particle size of about 60–70 microns, along with selective acidic bottom upgrading components in the range of 0–10 wt %.

In still another embodiment, the unconverted heavy hydrocarbon fraction from the second riser, that is being recycled into the second riser, ranges from about 0–50 wt % of the main feed rate (i.e. 370° C.+ fraction) from the first riser to the second riser, depending on the nature of the feedstock and operating conditions kept in the risers.

In yet another embodiment, the amount of steam used for feed dispersion and atomization in the first and the second riser reactors is in the range of about 1–20 wt % of the respective total hydrocarbon feed depending on the quality of the feedstock.

In further embodiment, the spent catalyst resides in the stripper for a period of up to 30 seconds.

In another embodiment, the pressures in the first and second riser reactors are in the range of 1.0 to 4.0 kg/$cm^2$(g).

In yet another embodiment, the regenerated catalyst entering at the bottom of the second riser reactor has coke of about 0.1–0.3 wt %, is at a temperature of about 600–750° C., and is lifted by catalytically inert gases.

In a further embodiment, the combined total cycle oil (150–370° C.) product, which is a mixture of heavy naphtha (150–216° C.) and light cycle oil (216–370° C.), has a higher cetane number than that from conventional distillate mode FCC unit and other properties, such as specific gravity, viscosity, pour point, etc. that are in the same range as of the similar boiling range products of a commercial distillate mode FCC unit.

In still another embodiment, by changing the cut point of the TCO from the first riser to 120–370° C., processing 370° C.+ part of the first riser product in the second riser, and changing the cut point of TCO from second riser to 120–390° C., the yield of overall combined TCO product increases by 8–10 wt % and the combined TCO product has substantially the same properties, but improved cetane number, as that of TCO from commercial distillate mode FCC unit.

BRIEF DESCRIPTION OF THE ACCOMPANYING DRAWINGS

The invention is illustrated hereinbelow with reference to the following accompanying drawings, wherein.

Figure 1:
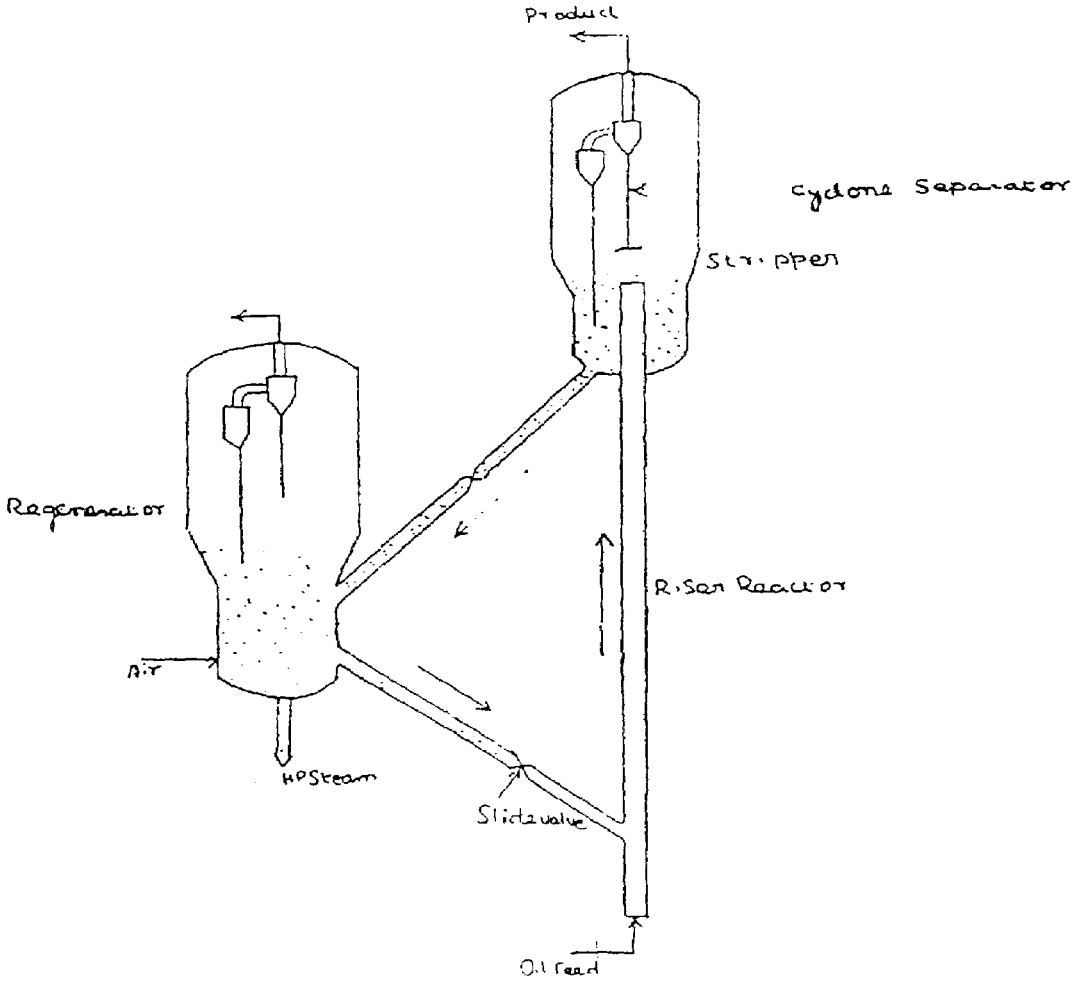
FIG. 1 shows a conventional fluid catalytic cracking single riser system.

The reference numbers of the several figures of the drawing are unique to each figure.

Description of FIG. 1

In the conventional Fluid Catalytic Cracking (FCC) unit, fresh feed (1) is injected at the bottom of the riser (2) whereupon it comes into contact with hot regenerated catalyst from the regenerator (3). The catalyst along with hydrocarbon feed and product vapors ascends the riser and at the end of the riser spent catalyst is separated from the hydrocarbon vapor and subjected to steam stripping. The hydrocarbon vapors from the riser reactor are sent to a main fractionator column (4) for separating into the desired products. The stripped catalyst is passed to a regenerator (3) where the coke deposited on the catalyst is burnt off and the clean hot catalyst is circulated back to the bottom of the riser.

Figure 2:
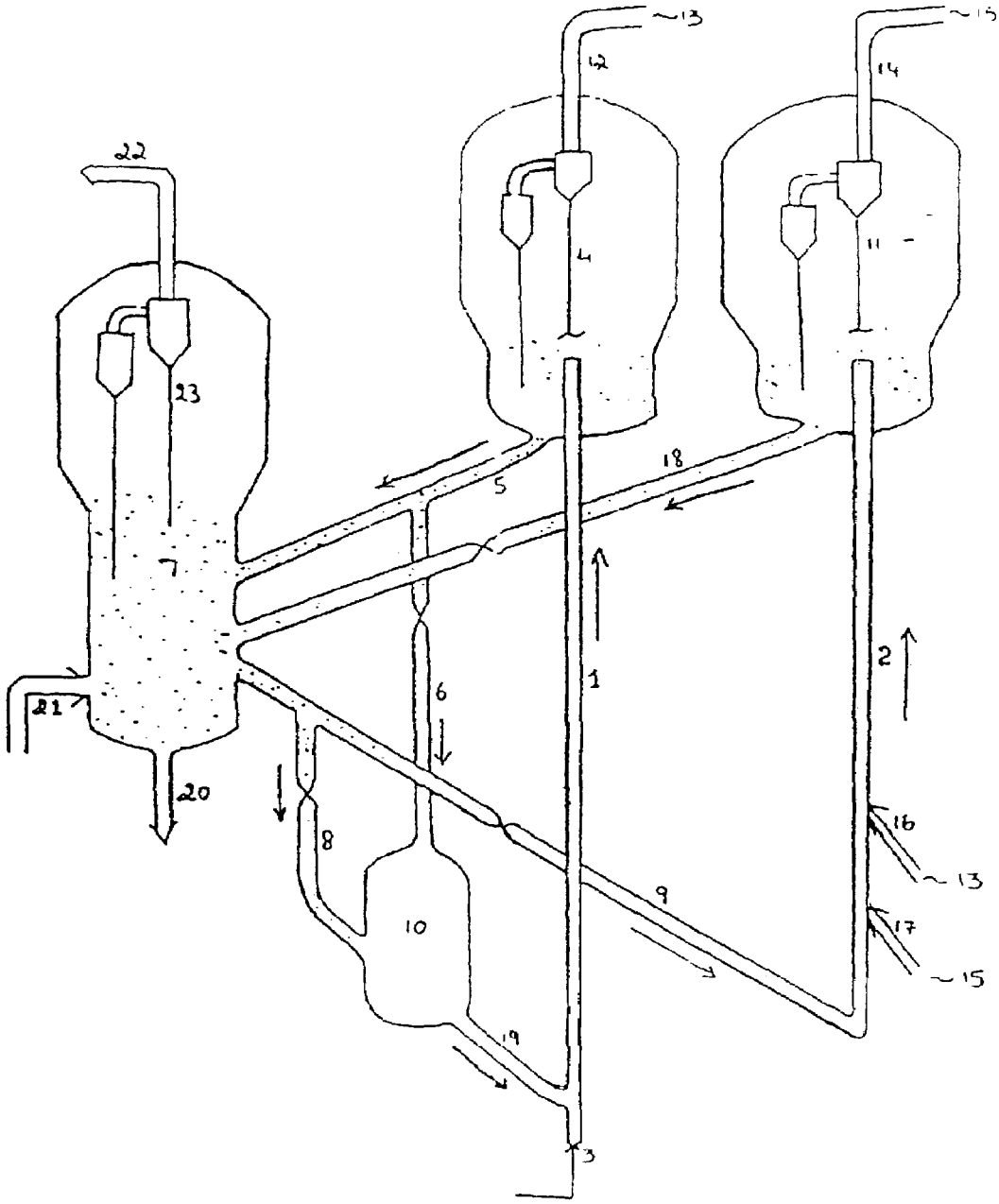
FIG. 2 shows a fluidized catalytic cracking two riser system of the present invention.

The fluidized catalytic cracking two riser system of the invention is schematically shown in FIG. 2, and described in detail hereinbelow.

The fluidized bed (sometimes referred to as a transport bed) catalytic cracking system for the production of high yield of middle distillate products, comprising hydrocarbons having numbers of carbon atoms in the range of about $C_8$ to $C_{24}$, from heavy petroleum feeds, comprises at least two riser reactors (1 and 2). A fresh feed is introduced into the first riser reactor (1), typically at the bottom section but above regenerated catalyst entry zone through a feed nozzle (3). At the end of the first riser reactor (1), the spent catalyst is quickly separated from hydrocarbon product vapors, using separating devices (4), and the separated catalyst is subjected to multistage steam stripping to remove any entrained hydrocarbons. A conduit (5) feeds a part of the said stripped catalyst into a regenerating apparatus (7) and another part of the stripped catalyst from the conduit (5) travels through another conduit (6) into a mixing vessel (10). Thereafter, the mixed catalyst from the mixing vessel (10) travels through a conduit (19) and is fed to the bottom of the first riser reactor (1). The hydrocarbon product vapors from the first riser reactor (1), which are separated from the catalyst in the separating devices (4), are fed to a vacuum or atmospheric distillation column (13) through conduit (12) whereby the first cracked hydrocarbon products are separated into a first fraction, comprising hydrocarbons having boiling points less than or equal to 370° C., and a second fraction, comprising hydrocarbons with boiling points greater than or equal to 370° C. which includes uncracked hydrocarbons. The said second fraction, comprising uncracked hydrocarbon products, is fed through feed nozzle (16) into the bottom of a second riser reactor (2) above the regenerated catalyst entry zone, and the regenerated catalyst from the regenerating apparatus (7) is fed to the bottom of the second riser reactor (2) through a conduit (9). Subsequently, the hydrocarbon products of the second riser reactor (2) are separated from the catalyst, in separating devices (11), and the cracked products of the second riser reactor (2), along with the products of the first fraction of the first riser reactor (1) comprising hydrocarbons with boiling points less than or equal to 370° C., are fed to a main fractionator column (15) that conventionally separates the said products into dry gas, LPG, gasoline, heavy naphtha, light cycle oil, heavy cycle oil, and slurry oil. The entire heavy cycle oil and all or part of the slurry oil, consisting mainly of hydrocarbons with boiling points greater than or equal to 370° C., are recycled back to the second riser reactor (2) through a separate feed nozzle (17) located at a point lower than the position of introduction of main feed. The feed and cracked product vapors travel along with the catalyst, through the riser reactor whereupon the spent catalyst is separated from product vapors of the second riser reactor (2) in separating devices (11), and the spent catalyst is subjected to multistage steam stripping for removal of entrained hydrocarbons. The stripped catalyst travels through a conduit (18) into the regenerating apparatus (7), wherein the coke on catalyst is burnt in the presence of air and/or oxygen containing gases at high temperature, and the flue gas from regeneration is separated from the entrained catalyst fines in separating devices (20) and the flue gas leaves from top of the regenerating apparatus (7) through a conduit (21) for heat recovery and venting through stack. The hot regenerated catalyst is withdrawn from the regenerating apparatus (7) and divided into two parts, one going to the mixing vessel (10) through the conduit (8) and the other directly to the bottom of the second riser reactor (2). The mixed catalyst from the mixing vessel (10) is fed through the conduit (19) to the inlet of the first riser reactor (1). The level of the catalyst bed is controlled in the individual or common stripper. The catalyst circulation rate from the common regenerator and the quantity of the spent and regenerated catalyst entering into the mixing vessel (10) is controlled using slide valves placed in the conduits and thereby producing high yield of middle distillate products.

At the bottom 'Y' section of both the risers (1 & 2), steam is used to lift the catalyst in upward direction up to the feed entry zone. Also steam is used in the feed nozzles (3, 16 & 17) for atomization and dispersion of the feed. The quantity of the steam flow into the respective risers (1 & 2) is varied depending on the feedstock quality and the desired velocity in the risers.

As an example, a system designed to practice the process of the invention has been described employing only two riser reactors. It is pertinent to note that in practice, riser reactors of any desired number may be functionally attached downstream of the second riser reactor so that the unconverted hydrocarbons obtained from the second riser may be further treated in accordance with the process described hereinabove and eventually, substantially pure middle distillate products may be obtained in high yield from the original feed.

In catalytic cracking processes using zeolite based catalyst, the reactions proceed sequentially. Middle distillate yield can be increased, if cracking thereof to lighter products is restricted. Any attempt in this regard is likely to reduce the conversion, resulting in higher yield of unconverted products. Conventionally, recycling of unconverted fraction has been practiced to improve the overall conversion. The severity required for cracking of the unconverted recycled fraction is adequate to produce significant quantity of gasoline and LPG by over-cracking of middle distillate range product. It also promotes hydrogen transfer reactions producing aromatics in middle distillate range products and therefore, deteriorates the cetane quality. To summarize, it may be noted that maximization of intermediate product middle distillate by a cracking reaction is more challenging as compared to maximization of gasoline.

In distinction to other prior art processes, the present invention provides a process for producing maximized quantity middle distillate through catalytic cracking of heavy hydrocarbon fractions employing multiple risers. The applicants realized that the middle distillate selectivity is higher only at lower conversion. In fact, the ratio of yield of total cycle oil (TCO: 150–370° C.) to the sum of other products, (such as, dry gas, LPG, gasoline and coke) increases as the conversion reduces. Moreover, riser temperature has dramatic impact on the selectivity. At same conversion, the applicants have found that middle distillate selectivity improves significantly as riser temperature is reduced. The applicants have also investigated the role of coke on regenerated catalyst (CRC) and discovered that there is an optimum CRC for maximum yield of TCO (Ref.: Ind. Chem. Res., 32, 1081, 1993). Finally, the applicants have arrived at some specific conditions (comprising lower riser temperature, low contact time, low catalyst oil ratio, higher CRC, etc.) and type of the catalyst with which yield of TCO is maximized.

According to the present invention, petroleum feed stocks, such as vacuum gas oil (VGO), coker fuel oil, coker/visbreaker heavy gas oil, hydrocracker bottom, etc., are catalytically cracked in presence of solid zeolite catalyst with or without selective acidic bottom cracking components in multiple riser-reactors. The feed is first preheated to a temperature in the range of about 150–350° C. and then injected into a pneumatic flow, riser type cracking reactor with a residence time of about 1–8 seconds, and preferably of about 2–5 seconds. At the exit of the riser, hydrocarbon vapors are quickly separated from catalyst for minimizing the over cracking of middle distillate to lighter products.

The product from the first riser is separated in a fractionator into at least two streams, one comprising hydrocarbons having boiling points below about 370° C. and the other comprising hydrocarbons having boiling points greater than about 370° C. The removal of hydrocarbon products having boiling points less than or equal to about 370° C. reduces the chance of over-cracking of middle distillate range molecules to lighter products. The fraction, comprising hydrocarbons, including unconverted hydrocarbons, having boiling points greater than or equal to about 370° C., from the first riser is pre-heated and then injected to the second riser reactor with residence time of about 1–12 seconds, and preferably in the range of about 4–10 seconds, through the feed nozzles located at a higher elevation. In the second riser, the regenerated catalyst is contacted with the recycle stream of unconverted heavy hydrocarbons from the second riser at a relatively lower elevation of the riser. This allows preferential cracking of the recycle components under high severity conditions (e.g., higher temperature, higher dynamic activity of the catalyst owing to low coke on regenerated catalysts) at the bottom of second riser. Typically, recycle ratio is maintained in the range of about 0–50% of the feed throughput in the second riser.

Steam and/or water, in the range of 1–20 wt % of feed, is added for dispersion and atomization in both the risers depending on type of feedstock. The desired velocity in the risers, especially in the first riser, is adjusted by the addition of steam.

The hydrocarbon product vapor from the second riser is quickly quenched with water/another, cooler hydrocarbon fraction and separated for minimizing the post riser non-selective cracking. The product from the second riser and the product boiling below about 370° C. from the first riser are separated in a common fractionator into several products, such as dry gas, LPG, gasoline, heavy naphtha, light cycle oil and cracked bottoms. Part of the bottom product, including unconverted hydrocarbon feed, (the 370° C.+ fraction) from the second fractionator is recycled to the second riser and a remaining part is sent to rundown after removal of catalyst fines.

The spent catalyst, with entrained hydrocarbons from the riser exit, is then passed through a common or separate stripping section where counter current steam stripping of the catalyst is carried out to remove the hydrocarbon vapors from the spent catalyst. The catalyst residence time in the strippers is required to be kept in the lower side of preferably less than about 30 seconds. This helps to minimize undue thermal cracking reactions and also reduces the possibility of over-cracking of middle distillate range products. Stripped catalyst is then passed to a common dense or turbulent fluidized bed regenerator where the coke on catalyst is burnt in presence of air and/or oxygen containing gases to achieve coke on regenerated catalyst (CRC) of lower than about 0.4 wt % and preferably in the range of about 0.1–0.3 wt %. A part of the regenerated catalyst is directly circulated to the second riser reactor via standpipe/slide valve at a temperature of 600–750° C.

As mentioned earlier, there is an optimum CRC at which maximum TCO yield is obtained. In order to extract maximum TCO from the first riser, CRC is required to be maintained at relatively higher level, for example in the range of 0.2–0.8 wt % depending on catalyst and operating conditions. In the second riser, the desirable CRC is relatively lower (for example in the range of 0.1–0.3 wt %) in order to utilize the full activity potential of the catalyst. Also, the temperatures of the regenerated catalyst entering into the two risers are different. The lower temperature and higher CRC of the catalyst entering to the first riser is achieved by mixing a part of the stripped catalyst from the first riser/common stripper with regenerated catalyst in a separate vessel equipped with fluidization steam, and circulating the mixed catalyst to the bottom of the first riser via a stand pipe/slide valve. The mixed catalyst enters at the bottom of the first riser with a temperature in the range of about 450–575° C. (preferably in the range 475–550° C.) and CRC of lower than about 0.8 wt % (preferably in the range of 0.25–0.5 wt % depending on type of catalyst). Another option for controlling the catalyst return temperature in the first riser is to employ a catalyst cooler so that catalyst/oil ratio can be controlled substantially independently. However, the instant mixing vessel is preferred since it acts as second stage stripper and helps to adjust the coke level on the catalyst.

Prior to the injection of the 370° C.+ fraction of the first riser product, the fresh regenerated catalyst is contacted with a recycle stream comprising unconverted hydrocarbons from the second riser at a relatively lower elevation of the riser. The recycle components are preferentially cracked at the high severity conditions prevailing in the second riser bottom before the injection of 370° C.+ fraction of first riser product. Typically recycle ratio is maintained in the range of about 0–50% of the second reactor feed throughput depending on the type of the feed to be processed and the conversion level in both the reactors. If the recycle rate is less, it may be injected along with the main feed i.e., 370° C.+ fraction of first riser product.

In the present invention, the first riser operates in the range of about 150–350 $hr^{-1}$ weight hourly space velocity (WHSV), about 2–8 catalyst to oil ratio, and about 400–500° C. riser top temperature to convert the feedstock to selectively cracked product including 35–45 wt % min. TCO yield and 40–60 wt % 370° C.+ (bottom) yield. The second riser operates in the range of about 75–275 $hr^{-1}$ WHSV, about 4–12 catalyst to oil ratio and about 425–525° C. riser top temperature. The absolute pressures in both reactors are about 1–4 $kg/cm^2$ (g). Steam and/or water, in the range of about 1–20 wt % of feed, is added not only for dispersion and atomization of feed but also to attain the desired fluidization velocity in the risers, especially in the first riser bottom. It also helps in avoiding the coke formation or catalyst agglomeration.

Comparison of major process conditions of the process of the present invention with conventional FCC & multi stage process is shown below:

TABLE 1

| | Multistage process of the present invention | | | | |
|---|---|---|---|---|---|
| | first reactor | | second reactor | | FCC |
| | Range | Preferred Range | Range | Preferred Range | Process Range |
| WHSV,$hr^{-1}$ | 150–350 | 200–300 | 75–275 | 120–220 | 125–200 |
| Catatyst/Oil ratio (w/w) | 2–8 | 3–5 | 4–12 | 5–8 | 4–8 |
| Riser temp., ° C. | 400–500 | 425–475 | 425–525 | 460–510 | 490–540 |
| Steam injection, wt % of feed | 1–20 | 8–12 | 1–20 | 4–8 | 0–10 |

Figure 3:
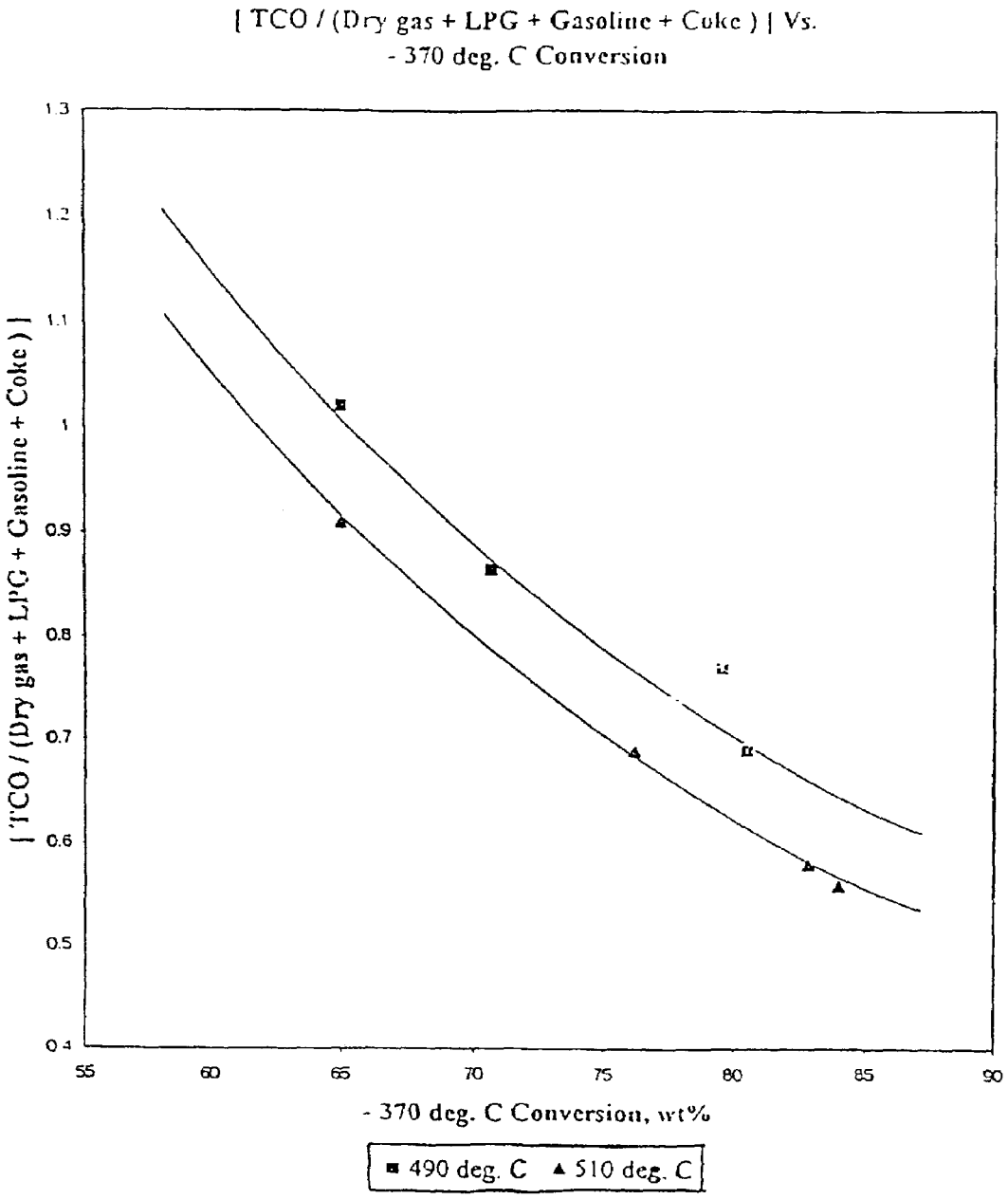
FIG. 3 is a graph showing the ratio of TCO Yield/Yields of (rygas+LPG+asoline+oke) Vs. −370° C. conversion with first riser feed at two different temperatures (425° C. & 490° C.).

Use of multiple riser concepts is not new, as each researcher has employed it for different purposes. The present invention utilizes dual or multiple riser systems for the exclusive purpose of maximization of middle distillate products. Being an intermediate product, middle distillate range molecules have a tendency to undergo further cracking. There is always a trade off between maximization of an intermediate range product and minimization of bottom unconverted part. This invention includes the sequence of operation and operating conditions for control of over-cracking of middle distillate in the first riser and upgradation of heavier molecules to middle distillate in the second riser. This invention provides a novel scheme for operation of two or multiple risers at entirely different operating conditions with a common regenerator. Use of so much lower temperature cracking is unusual so far. However, the applicants have found that reaction temperature has a predominant effect on the over cracking of middle distillate range products. For example, at 40 wt % 370° C.− conversion, the wt % yield ratios of TCO and all other products, (i.e., dry gas, LPG, gasoline & coke) except TCO and bottom (subsequently referred as TCO/Rest ratio) are in the range of about 3.0–3.5 and about 1.5–1.8 at reaction temperatures of 425° C. and 490° C. respectively. The difference in the above ratio is narrowed down as the conversion increases (FIG.-3).

Therefore, for maximizing TCO, low reaction temperature, low catalyst to oil ratio, as well as low catalyst activity is desirable. The applicants identified that lower catalyst/oil ratio (2–8) and higher WHSV of (150–350 $hr^{-1}$) along with lower riser temperature in the first riser of the process of the present invention are very important to achieve a very low degree of over cracking for producing maximum middle distillate range components. The applicants also observed that the TCO/Rest ratio is significantly affected by the 370° C.– conversion level. For example, for a given catalyst and reaction temperature, if 370° C.– conversion is 40%, the TCO/Rest ratio is as high as 3.2 which comes down to about 1.3 when 370° C.– conversion is increased to 70%. This shows that restricting the conversion in the first stage riser up to about 40–45% is very important to maximize the yield of middle distillate.

In the second riser, the operating conditions need to be different for up gradation of heavy material to lighter products. However, undue increase in severity parameters will lead to conversion of the desired middle distillate to LPG and gasoline. The applicants have discovered that operation at an intermediate severity as compared to gasoline maximization mode FCC operation is absolutely necessary. The applicants have also found that in order to reduce the yield of unconverted bottoms and improve the middle distillate selectivity, recycle to a lower elevated entry point at the bottom of the second riser is very much effective. This allows the cracking of the recycled heaviest fraction in effective contact with regenerated catalyst at relatively higher temperature and lower CRC that improves the dynamic activity of the catalyst and offers maximum cracking of the recycled feed. After cracking of the recycled part, the catalyst temperature comes down due to utilization of part of the heat for vaporization and endothermic cracking reactions of the recycled feed. Also, the coke on catalyst increases which essentially blocks some of the active sites and thereby reduces the dynamic activity of the catalyst. The contacting of catalyst having relatively lower temperature and higher coke on catalyst with the main feed, comprising the hydrocarbon fraction from the first riser having boiling points greater than or equal to about 370° C., assists to improve the selectivity of middle distillate range products out of the second riser. This contacting pattern is highly effective in increasing the overall yield of the middle distillate and reducing yield of the unwanted slurry oil.

In the present invention, the delta coke (defined as the difference in coke content of spent and regenerated catalyst) is low due to lower coke make in the extremely low severity cracking in the first riser which is expected to keep the regenerator temperature at a relatively lower level as compared to the conventional FCC operation using similar type of feedstocks. However, overall lower catalyst to oil ratio is likely to compensate for this effect and thereby maintain the regenerator temperature at least at the same level as that of conventional FCC as required for burning of coke off the catalyst.

Further details of feedstock, catalyst, products and operating conditions of the process of the present invention are described below:

Feed Stock:

Feed stock for the present invention includes hydrocarbon fractions starting from carbon no. 20 to carbon no. 80. The fraction could be straight run light and heavy vacuum gas oil, hydrocracker bottom, heavy gas oil fractions from hydrocracking, FCC, visbreaking or delayed coking. The conditions in the process of the present invention are adjusted depending on the type of the feedstock so as to maximize the yield of middle distillate. Details of the feedstock properties are outlined in the examples given hereinbelow. The above feed stock types are for illustration only and the invention is not limited in any manner to only these feed stocks.

Catalyst:

The catalyst employed in the process of the present invention predominantly comprises Y-zeolite in rare earth ultra-stabilized form. Bottom cracking components consisting of peptized alumina, acidic silica alumina or γ-alumina or a mixture thereof are also added to the catalyst formulation to produce synergistic effect towards maximum middle distillate production under the operating conditions as outlined above. It may be noted that both the first and second stage risers are charged with the same catalyst. The pore size range of the active components namely, Re-USY zeolite and bottom selective active materials are in the range of about 8–11 and 50–1000 angstroms respectively. The typical properties of the Y-zeolite based catalyst are given in Table-2.

TABLE 2

| | | |
|---|---|---|
| Surface Area, $m^2/g$, | Fresh | 110–180 |
| | Steamed | 100–140 |
| % Crystalinity | Fresh | 10–15 |
| | Steamed | 8–12 |
| Unit Cell Size, ° A | Fresh | 24.35–24.75 |
| | Steamed | 24.2–24.6 |
| Micro-pore area, $m^2/g$, | Fresh | 65–100 |
| | Steamed | 60–90 |
| Meso-pore area, $m^2/g$, | Fresh | 45–80 |
| | Steamed | 40–50 |
| Pore volume, cc/gm | | 0.25–0.38 |

In the process of the present invention, the active catalyst components are supported on relatively inactive materials such as silica/alumina or silica-alumina compounds, including kaolinites. The active components could be mixed together before spray drying or separately binded, supported and spray-dried using conventional spray drying technique. The spray-dried micro-spheres are washed, rare earth exchanged and flash dried to produce finished catalyst particles. The finished micro-spheres containing active materials in separate particles are physically blended in the desired composition. The preferred range of physical properties of the finished fresh catalyst as required for the process of the present invention:

| | |
|---|---|
| Particle size range, micron | 20–120 |
| Particle below 40 microns, wt % | <20 |
| Average particle size, micron | 50–80 |
| Average bulk density, micron | 0.6–1.0 |

Typically, the above properties and other related physical properties, e.g., attrition resistance, fludizability etc. are in the same range as used in the conventional FCC process.

Products:

The main products in the process of the present invention is the middle distillate components namely, heavy cracked naphtha (HCN:150–216° C.) and light cycle oil (LCO: 216–370° C.). The sum total of these two fractions, which is referred to as total cycle oil (TCO:150–370° C.) is obtained with a yield up to about 50–65 wt % of the feed. The other useful products of the process of this invention are LPG (5–12%) and gasoline (15–25 wt %). A range of other product yields from first and second stage risers are summarized in the following Table-3:

TABLE 3

| | Yield, wt % of feed | | |
|---|---|---|---|
| | From first reactor | From second reactor | Combined yield from both first & second |
| Dry Gas ($C_1 + C_2$) | 0.1–0.35 | 1–1.5 | 0.5–1.5 |
| LPG ($C_3 + C_4$) | 3–4 | 8–12 | 5–12 |
| Gasoline ($C_5$ – 150° C.) | 10–15 | 25–30 | 15–30 |
| Heavy Naphtha, (150–216° C.) | 8–10 | 10–13 | 10–15 |
| Light Cycle Oil, (216–370° C.) | 35–45 | 25–35 | 40–50 |
| Total Cycle Oil (150–370° C.) | 45–50 | 30–40 | 50–65 |
| Bottom (370° C. +) | 40–60 | 10–20 | 5–15 |
| Coke | 1–3 | 2–5 | 2–4 |

The invention and its embodiments are described in further detail hereunder, with reference to the following examples, which should not be construed to limit the scope of the invention in any manner. Various modifications of the invention that may be apparent to those skilled in the art are deemed to be included within the scope of the present invention.

EXAMPLE-1 (PRIOR ART)

Yield of Middle Distillate at Different Conversions in Conventional FCC Operation This example illustrates the change in yield of the middle distillate product (TCO) at different conversion levels under conventional FCC conditions. –216° C. conversion is defined as the total quantity of products boiling below 216° C. including Coke. Similarly –370° C. conversion is defined as the total quantity of products boiling below 370° C. including Coke. The experiments were conducted in standard fixed bed Micro Activity Test (MAT) reactor described as per ASTM D-3907 with minor modifications indicated subsequently as modified MAT. The catalyst to be used is first steamed at 788° C. for 3 hours in presence of 100% steam. The physico-chemical properties of the feed used in the modified MAT reactor are given in the following Table-4 & 5.

TABLE 4

| | |
|---|---|
| Density @ 15° C., gm/cc | 0.8953 |
| CCR, wt % | 0.32 |
| Sulfur, wt % | 1.12 |
| Basic Nitrogen, PPM | 366 |
| Paraffins, wt % | 44.4 |

TABLE 4-continued

| | |
|---|---|
| Naphthenes, wt % | 18.1 |
| Aromatics, wt % | 37.6 |
| Nickel, PPM | <1 |
| Vanadium, PPM | <1 |

The runs were taken at a reaction temperature of 495° C., feed injection time of 30 seconds with WHSV in the range of 40–120 $hr^{-1}$. Catalysts used in this example are catalyst A & B which are commercially available FCC catalyst samples having properties as shown in the Table-6.

TABLE 5

| ASTM Distillation (D1160): | |
|---|---|
| Volume % | Temperature, ° C. |
| IBP | 299 |
| 5/12/15/20/30/40 | 342/358/371/381/401/418 |
| 50/60/70/80/90/95 | 432/444/458/474/497/515 |
| FBP | 550 |

TABLE 6

| | | Catalyst-A | Catalyst-B |
|---|---|---|---|
| Surface Area, $m^2/gm$ | Fresh | 170 | 272 |
| | Steamed | 103 | 208 |
| Pore Volume, cc/gm | | 0.22 | 0.26 |
| ABD, gm/cc | | 0.81 | 0.79 |
| Crystalinity, % | Fresh | 18.9 | 27.7 |
| | Steamed | — | 23.2 |
| UCS, ° A | Fresh | 24.61 | 24.56 |
| | Steamed | 24.32 | 24.31 |
| Chemical Analysis, wt % | | | |
| $Al_2O_3$ | | 56.5 | 30.85 |
| $Re_2O_3$ | | 1.44 | 1.03 |
| Fe | | 0.49 | 0.53 |
| APS, microns | | 74 | 77 |

The product yields along with conversions are given in Table-7 wherein it is observed that as both –216° C. and –370° C. conversions increase, TCO yield increases up to an optimum value and thereafter, it reduces with further increase in conversion. TCO being an intermediate product, undergoes further cracking as reaction severity increases. Therefore, in order to maximize TCO yield, the over-cracking is to be restricted.

TABLE 7

| | Product Yield, wt % | | | | | | |
|---|---|---|---|---|---|---|---|
| | Catalyst A | | | | Catalyst B | | |
| W/F, Min. | 0.51 | 0.62 | 0.94 | 0.44 | 0.51 | 0.63 | 0.94 |
| Hydrogen | 0.018 | 0.021 | 0.041 | 0.025 | 0.025 | 0.033 | 0.046 |
| Dry gas | 0.44 | 0.56 | 1.14 | 0.59 | 0.64 | 0.86 | 1.46 |
| LPG | 7.33 | 8.82 | 13.61 | 6.18 | 6.97 | 10.09 | 12.34 |
| Gasoline | 19.32 | 23.43 | 30.78 | 17.20 | 20.50 | 25.03 | 30.94 |
| TCO | 40.09 | 41.53 | 37.79 | 36.33 | 37.97 | 39.94 | 37.67 |
| Bottom (370° C.+) | 31.81 | 24.52 | 14.25 | 38.73 | 32.82 | 22.80 | 14.92 |
| Coke | 0.99 | 1.13 | 2.39 | 0.95 | 1.08 | 1.25 | 2.61 |
| –216° C. Conversion | 40.17 | 47.50 | 62.45 | 34.96 | 40.34 | 49.98 | 60.99 |
| –370° C. Conversion | 68.19 | 75.48 | 85.75 | 61.27 | 67.18 | 77.20 | 85.08 |

EXAMPLE-2

Effect of Reaction Temperature on Middle Distillate Yields at Same Conversion

This example illustrates the effect of reaction temperature on the yield of middle distillate at a given −216° C. conversion. The experiments were conducted in the modified MAT reactor with the same feed as mentioned in Example-1, at two different temperatures, viz., 425° C. and 495° C. Catalyst employed here is catalyst C which is commercially available FCC catalyst of following properties as shown in the Table-8.

TABLE 8

| | | Catalyst-C |
|---|---|---|
| Surface Area, $m^2$/gm | Fresh | 172 |
| | Steamed | 119 |
| Pore volume, cc/gm | | 0.32 |
| Crystallinity, % | Fresh | 13.80 |
| | Steamed | 10.20 |
| UCS ° A | Fresh | 24.55 |
| | Steamed | 24.31 |
| Chemical Analysis, wt % | | |
| $RE_2O_3$ | | 0.69 |
| $Al_2O_3$ | | 36.40 |
| $Na_2O$ | | 0.11 |
| Particle size, micron/wt % | | |
| −20/−40/−60/−80/−105/−120 | | 3/16/32/56/77/86 |
| APS, micron | | 76 |

TABLE 9

| Temperature, ° C. II | 425 | | 495 | |
|---|---|---|---|---|
| −216° C. conversion, wt % | 30 | 50 | 30 | 50 |
| W/F, Min. | 1.1 | 2.7 | 0.10 | 0.5 |
| Yield Pattern, wt % | | | | |
| Dry gas | 0.20 | 0.42 | 0.38 | 0.56 |
| LPG | 4.10 | 9.1 | 5.07 | 10.72 |
| Gasoline | 14.94 | 23.52 | 16.00 | 24.58 |
| Heavy naphtha | 9.50 | 14.27 | 7.11 | 11.20 |
| LCO | 28.68 | 32.00 | 25.80 | 24.50 |
| TCO | 38.18 | 46.27 | 32.91 | 35.70 |
| Bottom (370° C. +) | 41.32 | 18.00 | 44.20 | 25.40 |
| Coke | 1.26 | 2.69 | 1.44 | 2.94 |
| 370° C. Conversion | 58.68 | 82.00 | 55.80 | 74.60 |
| TCO/Rest | 1.86 | 1.29 | 1.43 | 0.92 |

The conversion was varied by changing W/F ratio. The product yields are compared at the same −216° C. conversion but at different temperatures. It is noted from Table-9 that at higher temperature, TCO yield and more importantly the TCO/Rest ratio (the ratio of TCO yield and yield of other products e.g., dry gas, LPG, gasoline and coke except bottom and TCO) are much lower in the case of higher reaction temperature. For example, at a given −216° C. conversion, TCO yield at 425° C. temperature is about 6–10% higher than that at 495° C. The other significant point is that at a low temperature of 425° C., it has been possible to get 46% TCO yield (per pass) at 50% −216° C. conversion. Similarly, there is a significant improvement in TCO/Rest ratio for 425° C. as compared to that of 495° C. at same conversion. This clearly demonstrates that in order to conserve middle distillate range molecules, low reaction temperature is a desirable parameter.

EXAMPLE-3

First Stage Riser Cracking Conditions

This example illustrates the significance of first stage riser cracking conditions, e.g., temperature, catalyst/oil ratio and conversion, on the yield of middle distillate and other products while employing commercially available FCC catalysts A and C, properties of which are described in Example-1 & 2 respectively. The tests were conducted in modified fixed bed MAT unit with same feed as described in Example-1. Yield data were generated at different conversion level for the catalysts as indicated above and the yields of different products were obtained. TCO/Rest ratios at different conversion levels are plotted in FIG.-3, from which it is observed that for both the catalysts, the TCO/Rest ratio increases as the −370° C. conversion is reduced. Therefore, it is important to note that the per pass −370° C. conversion in the first stage riser should be kept below about 45% and preferably below 40%.

From FIG.-3, it is also observed that the TCO/Rest ratio is a strong function of the reactor temperature for a given conversion and catalyst. For example, with catalyst C, while reducing reaction temperature from 490 to 425° C., the TCO/Rest ratio is increased from 3.4 to 3.75 at about −370° C. conversion level of 40%. This clearly shows that for the first stage cracking, the reaction temperature should be kept lower, preferably in the range of about 425–450° C.

EXAMPLE-4

Catalyst Characteristics for Middle Distillate Maximization

One of the important observations as illustrated in Example-3, is that for maximization of middle distillate yield, it is desirable to restrict the per-pass conversion to within about 40–45%, and to operate the first stage riser at lower reaction temperature. In this example, we illustrate the importance of catalyst characteristics to obtain higher yield of middle distillate out of the dual/multi-stage risers.

MAT activity is measured in ASTM MAT units using a standard feedstock and defined as the wt % of products boiling below 216° C. including coke at ASTM conditions. All other experiments were conducted at a temperature of 425° C. in the modified MAT reactor with the same feed as described in Example-1 and different catalysts. The important properties of the catalysts and the yield/conversion data are compared in Table-10.

TABLE 10

| | Catalyst-A | Catalyst-C | Catalyst-D | Catalyst-E |
|---|---|---|---|---|
| Surface Area, $m^2$/gm | 103 | 119 | 110 | 20 |
| Zeolite Area, $m^2$/gm | 59 | 80 | 62 | — |
| Rare earth content, wt % | 1.44 | 0.69 | 1.40 | — |
| Matrix Area, $m^2$/gm | 44 | 39 | 48 | — |
| Zeolite/Matrix ratio | 1.34 | 2.05 | 1.29 | — |
| MAT Activity | 71.38 | 74.02 | 70.19 | 13.55 |
| TCO Yield at 40% −370° C. Conversion | 31.00 | 32.01 | 30.90 | 31.20 |
| TCO yield/Rest ratio at 40% −370° C. Conversion | 3.44 | 4.00 | 3.39 | 3.30 |
| W/F for 40% −370° C. conversion | 0.22 | 0.25 | 0.22 | 3.5 |

TABLE 11

| | Catalyst-A | Catalyst-C | Catalyst-D |
|---|---|---|---|
| TCO Yield at 80% −370° C. Conversion | 38.45 | 34.78 | 43.0 |
| TCO yield/Rest ratio at 80% −370° C. conversion | 0.95 | 0.80 | 1.08 |

It is seen that the zeolite/matrix ratio, TCO yields at 40% −370° C. conversion, TCO/Rest ratio are in the order of C>A>D. In catalyst C, the available active matrix is adequate to crack the large molecules which are crackable under the prevailing operating conditions but it requires slightly higher W/F ratio. Higher zeolite quantity (proportion) is also synergistically taking part in the over all cracking activity but the conversion of middle distillate to lighter products is not increasing corresponding to higher zeolite content due to lower temperature. However for catalyst-E, whose activity is extremely low, at 40% of −370° C. conversion, both TCO yield and TCO/Rest ratio is comparable to those with the higher active catalysts. But W/F ratio required to achieve 40% −370° C. conversion is much higher which is difficult to achieve. At comparable W/F ratio, −370° C. conversion will be very low, producing very low amount of TCO. Therefore, such low active catalyst is not useful for producing maximum distillate.

Experiments with catalysts A, C & D at a reaction temperature of 495° C. corresponding to the second riser conditions were taken and the TCO yield and TCO/Rest ratio are compared at −370° C. conversion of 80% in Table-11. Both the TCO yield and TCO/Rest ratio are found to be in the order of D>A>C. It may be noted that the zeolite/matrix ratio is just in the reverse order i.e., C>A>D. The higher quantity of zeolite as well as the high zeolite/matrix ratio in catalyst C, is resulting in overcracking of middle distillate range molecules into lighter products. For a given −370° C. conversion, the −216° C. conversion is much higher for catalyst C. It is quite clear that the catalyst which is supposed to be the best in the first riser conditions, may not be that much good for the second riser conditions as for as TCO maximization is concerned. This demonstrates that in order to achieve maximum TCO and minimum Bottom yield, some optimization of the catalyst properties is essential.

EXAMPLE-5

Impact of Cracking Conditions for Second Stage Riser Operation

This example illustrates the significance of second stage riser cracking conditions e.g., temperature, catalyst/oil ratio and conversion on the yield of middle distillate. The tests were conducted in modified fixed bed MAT unit as described in Example-1, using catalyst C, at the temperature of 425, 490 and 510° C. The feed stock used is 370° C.$^+$ product obtained from first stage cracking in circulating riser FCC pilot plant, the properties of which is summarized in Table-13. Product yields data were generated at different conversion levels at different temperatures for catalyst C and according the TCO/Rest ratios at different conversion levels are plotted in FIG.-4.

TABLE 12

| | |
|---|---|
| Density, gm/cc @ 15° C. | 0.903 |
| CCR, wt % | 0.43 |
| Sulfur, wt % | 1.75 |
| Olefins, wt % | Nil |
| Saturates, wt % | 59.0 |
| Aromatics, wt % | 41.0 |

Figure 4:
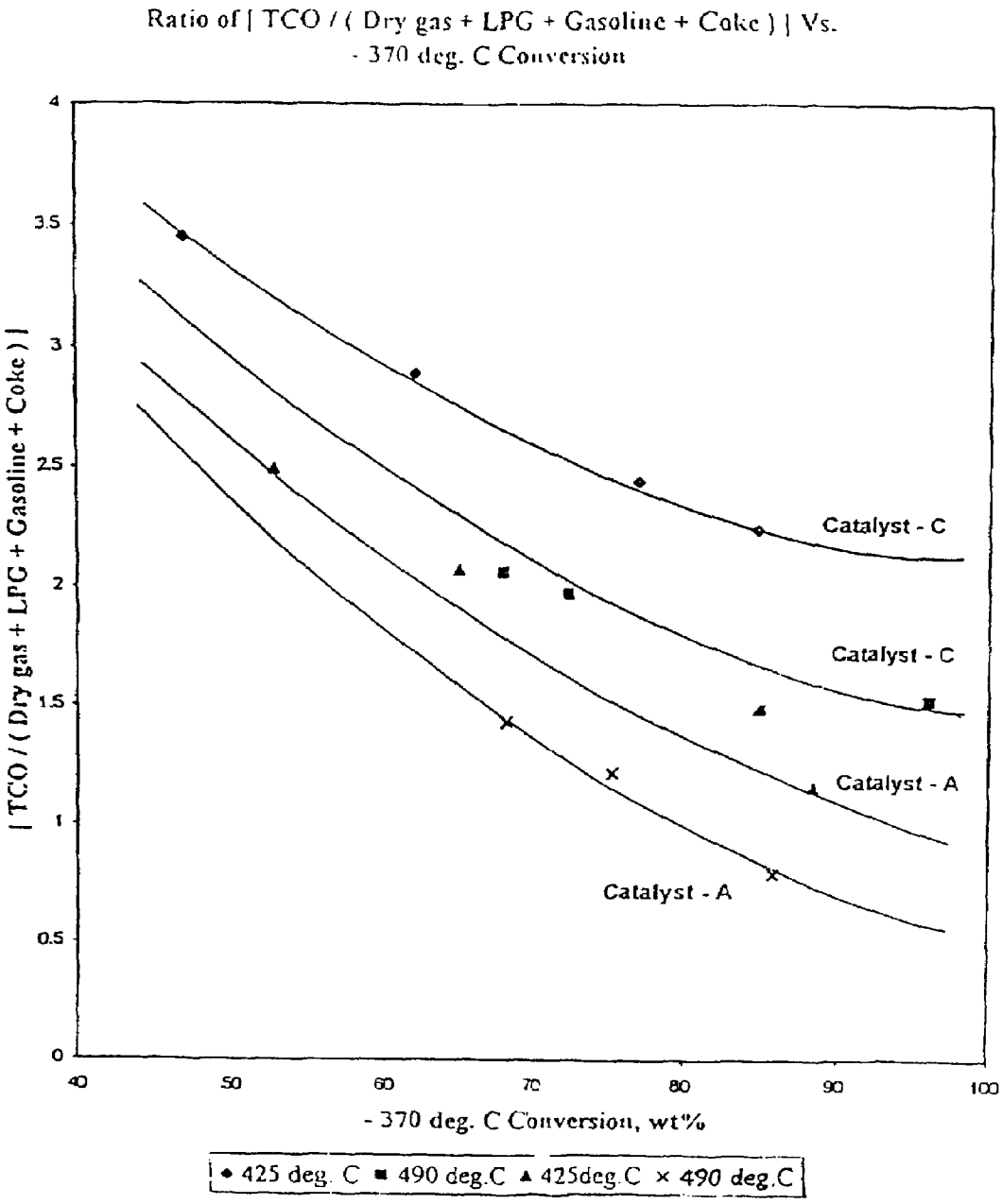
FIG. 4 is a graph showing the ratio of TCO Yield/Yields of (dry gas+LPG+gasoline+coke) Vs. −370° C. conversion with second riser feed at two different temperatures (490° C. & 510° C.).

From the FIG.-4, it is observed that at a given temperature, the TCO/Rest ratio increases as the −370° C. conversion reduces. Also, at a given −370° C. conversion, TCO/Rest ratio improves as the reaction temperature reduces. For example, at about −370° C. conversion of about 55%, TCO/Rest ratio increases from 1.22 to 1.34 as the temperature is reduced from 510 to 490° C. This clearly shows that even for the second stage cracking, the reaction temperature should be kept preferably lower. However, it will also lead to generation of higher quantity of bottom at same W/F ratio. At 425° C., W/F required to crack the 370° C.+ product from first stage cracking along with the recycle stream (unconverted part from the second riser) will be very high and hence difficult to achieve. Another important fact is that the mean average boiling point (MeABP) of second riser combined feed is definitely higher than that of first riser. Operation at lower temperature than the MeABP of the second riser combined feed is not desirable as it will lead to non-selective thermal cracking of the non-vaporized feed producing higher quantity of Coke and Dry gas. Considering these, it has been established that in the second riser, the reaction temperature should be preferably kept in the range of 460–510° C.

EXAMPLE-6

Combined Effect of Two Stage Cracking on Middle Distillate Yield

In this example, the yields from two stage catalytic cracking for maximization of middle distillate is demonstrated. The experiments have been conducted using catalyst C in continuously circulating fluid bed pilot plant of feed rate 0.75 kg/hr where both the riser and regenerator are operated isothermally. The feed is the same as mentioned in Example-1. After first stage cracking at 425° C., the product is separated into 370° C.− and 370° C.+ fractions. In the second stage, the 370° C.+ fraction is cracked at 495° C. using the same catalyst as used in the first stage. The product yields from the first and second stage cracking and also the combined yields are given in Table-13.

TABLE 13

| | first stage | second stage | Combined yields |
|---|---|---|---|
| Temperature, ° C. | 425 | 495 | |
| Yield Pattern, wt % | | | |
| Dry gas | 0.26 | 1.28 | 0.81 |
| LPG | 3.37 | 16.65 | 10.55 |
| Gasoline | 10.65 | 26.03 | 21.88 |
| Heavy naphtha | 8.54 | 13.31 | 14.28 |
| LCO | 32.33 | 19.47 | 40.73 |
| TCO | 40.87 | 32.78 | 55.01 |
| 370° C.$^+$ | 43.25 | 20.44 | 8.82 |
| Coke | 1.70 | 2.85 | 2.93 |

It is clearly seen that the ratio of yield of TCO and the sum of yields of dry gas, LPG, gasoline and coke (TCO/Rest) is very high in case of the first stage cracking, which is essentially contributing higher TCO yield for the overall process. For second stage cracking, the TCO/Rest ratio is similar to that of conventional distillate mode FCC unit as the severity required for minimizing the bottom yield is high enough to crack significant portion of TCO produced from heavy molecule cracking.

The yield comparison between single and dual riser cracking at similar −216° C. conversion with same catalyst and feed is compared in Table-14. It is seen that for same −216° C. conversion, −370° C. conversion is much higher resulting about 20% higher yield of TCO in case of two stage cracking. This establishes the workability of the concept of the present invention where process schemes, catalyst and operating conditions are such that TCO over-cracking is restricted with simultaneous upgradation of heavy molecules to TCO range molecules. Here, the first riser operates to extract as much TCO as possible while minimizing the yields of lighter products and the second riser is operated to upgrade as much bottom as possible while maximizing the yield of TCO. This process overcomes the trade off between lower bottom yield and higher TCO yield.

TABLE 14

| | Dual riser | Single riser |
|---|---|---|
| Temperature, ° C. | 425 & 495 | 495 |
| Yield Pattern, wt % | | |
| Dry gas | 0.81 | 0.56 |
| LPG | 10.55 | 10.72 |
| Gasoline | 21.88 | 24.58 |
| Heavy naphtha | 14.28 | 11.20 |
| LCO | 40.73 | 24.50 |
| TCO | 55.01 | 35.70 |
| 370° C.$^+$ | 8.82 | 25.40 |
| Coke | 2.93 | 2.94 |
| −216 conversion, wt % | 50.45 | 50.0 |

EXAMPLE-7

Comparison of Micro-Reactor & Circulating Pilot Plant Data

This example shows the comparison of individual product yields obtained from Micro-reactor and circulating Pilot Plant using the same catalyst and feedstock at a similar −216° C. conversion range. From the data summarized in Table-16, it is noticed that at similar conversion, there is an excellent match in gasoline, TCO and bottom yields. The main difference is coming in the yields of dry gas, LPG and coke. This is mainly due to the non-selective thermal cracking reactions occurring at the riser bottom as well as at the end of the riser in the pilot plant. This has resulted in relatively higher yield of dry gas and coke in the pilot plant riser. This example demonstrates that so far as the yields of TCO and un-reacted bottom are concerned, the inferences drawn based on either Micro-reactor or Pilot Plant data are going to be same.

TABLE 15

| | Pilot Plant data | | Micro-reactor data | |
|---|---|---|---|---|
| Feed rate, gm/min | 12.9 | 13.3 | — | — |
| CCR, gm/min | 55.5 | 53.0 | — | — |
| Cat/Oil (w/w) | 4.29 | 3.98 | — | — |
| W/F, min. | — | — | 0.609 | 0.501 |

TABLE 15-continued

| | Pilot Plant data | | Micro-reactor data | |
|---|---|---|---|---|
| Contact time, sec | — | — | 30 | 30 |
| −216 Conversion, wt % | 29.86 | 25.0 | 29.39 | 24.93 |
| Product Yields, wt % | | | | |
| Dry gas | 0.62 | 0.36 | 0.17 | 0.13 |
| LPG | 8.28 | 6.29 | 9.96 | 8.61 |
| Gasoline | 11.82 | 10.7 | 12.00 | 10.65 |
| Heavy Naphtha | 7.15 | 5.92 | 5.80 | 4.62 |
| LCO | 27.3 | 26 | 28.29 | 26.61 |
| TCO | 34.45 | 31.9 | 34.09 | 31.23 |
| 370° C. + | 42.82 | 49 | 42.31 | 48.46 |
| Coke | 2.00 | 1.71 | 1.46 | 0.91 |

EXAMPLE-8

Comparison of the Yields of Present Two Stage Process in Present Invention, Commercial FCCU and Two Stage Hydrocracker The product yields of the present invention are compared with that of commercial distillate mode FCC and two-stage hydrocracker units in Table-17. The data for the process of the present invention is the combined yield obtained from two stage cracking where the two risers are operated at 425° C. and 495° C., respectively.

TABLE 16

| Product yields, wt % of feed | Distillate mode FCC | Present process | Yields, wt % of feed | Distillate mode Hydro-cracker | Present process |
|---|---|---|---|---|---|
| Dry gas | 2.50 | 0.78 | Dry gas | 1.74 | 0.70 |
| LPG | 10.5 | 10.55 | LPG | 2.91 | 9.11 |
| Gasoline ($C_5$-150° C.) | 27.5 | 21.88 | Gasoline ($C_5$-120° C.) | 16.28 | 12.86 |
| Heavy Naphtha a (150–216° C.) | 12.5 | 14.28 | (120–216° C.) | — | 18.41 |
| | | | (120–285° C.) | 27.91 | — |
| LCO (216–370° C.) | 30.0 | 40.73 | (216–390° C.) | — | 50.39 |
| | | | | | — |
| TCO (150–370° C.) | 42.5 | 55.01 | (120–390° C.) | 73.26 | 68.80 |
| 370° C.$^+$ | 12.75 | 8.82 | 390° C.$^+$ | 5.81 | 5.85 |
| Coke | 4.25 | 2.93 | Coke | — | 2.68 |
| −216° C. conv. | 57.25 | 50.45 | −216° C. conv. | — | — |
| −370° C. conv. | 87.25 | 91.18 | −390° C. conv. | 94.19 | 94.15 |

It is observed that in the process of the present invention, the TCO yield is higher by about 12.50% as compared to the yield from a commercial FCC unit. By varying the cut point of TCO from 150–370° C. to 120–390° C. as reported for the hydrocracker unit, and processing the hydrocarbon product fraction from the first riser having boiling points greater than or equal to 390° C. in the second riser, the yield of TCO increases by about 14 wt %, which is only about 5% less than that from the commercial hydrocracker unit. Also, the conversion of hydrocarbon products having boiling points less than or equal to 390° C. (−390° C. conversion) is similar to what is achievable in a hydrocracker and −370° C. conversion is better than the distillate mode FCC unit. This demonstrates that, without using external hydrogen and operating under very high pressure, it is possible to produce higher yields of middle distillate product which are close to that from a distillate mode two stage hydrocracker unit.

EXAMPLE-9

Comparison of Properties of TCO Obtained in the Process of the Present Invention with Middle Distillate Products Obtained from Commercial FCCU and Two Stage Hydrocracker The properties of the TCO obtained from the process of the present invention is compared with TCO from commercial distillate mode FCC and Diesel from distillate mode two stage Hydrocracker units which is given in Table-17.

TABLE 17

| | Process of the present invention | | Distillate | Distillate mode |
|---|---|---|---|---|
| | 1 TCO | 2 Middle distillate | mode FCC 3 TCO | Hydrocracker 4 Diesel |
| TBP cut point, ° C. | 150–370 | 120–390 | 150–370 | 150–390 |
| Density @ 15° C., gm/cc | 0.8793 | 0.8863 | 0.8654 | 0.835 |
| Pour point, ° C. | 0.7 | 36 | 0–2 | 6–10 |
| Kinematic Viscosity @ 50° C., CST | 2.20 | 7.00 | 2.7 | 9.0 |
| PONA Analysis, wt % | | | | |
| Olefins | 19.97 | 6.82 | 18.6 | Nil |
| Saturates | 24.64 | 49.26 | 22.1 | 91 |
| Aromatics | 55.39 | 43.92 | 59.3 | 9 |
| Cetane no. | 36.22 | 38.39 | 28–30 | 63 |

Expectedly, the quality of diesel range product obtained from a hydrocracker is much superior in terms of cetane No., olefin and aromatics contents etc. than the cracked products made without using hydrogen. Mainly, the high aromatics content in cracked middle distillate product contribute to poor cetane quality. However, the viscosity and the pour point of hydrocracker diesel is poor as compared to TCO from a conventional FCC unit or the process of the present invention. From column 1 & 3, it is seen that the cetane No. of TCO obtained from the present process is higher by 6 units than TCO from conventional distillate mode FCCU. All other properties including the pour point are almost in the same range. In column 2, the properties of the product fraction of 120–390° C. range for the present process are listed. While cetane number of this fraction is still higher, the pour point, as well as the viscosity, are also higher. This has been mainly contributed by the hydrocarbon fraction of 370–390° C. cut from the first riser product of the present process. The pour point as well as the viscosity of this product fraction is very high and hence its inclusion in the middle distillate product is not desirable. If we take the 120–370° C. cut from the first riser product and the 120–390° C. cut from the second riser (while processing the 370° C.+ part of the first riser product into the second riser), the pour points and the kinematic viscosity @ 50° C. become 0.95° C. and 2.44 CST respectively, which are almost same as that of 150–370° C. product of the present invention as shown in the column 1 of Table-18. Additionally, by this approach, the yield of the middle distillate increases from about 55 wt % to 63.6 wt % without any adverse impact on flash point.

We claim:

1. A multi stage selective catalytic cracking process, for producing high yield of middle distillate products having carbon atoms in the range of about $C_8$ to $C_{24}$ from heavy hydrocarbon feed stocks in the absence of added hydrogen, said process comprising the steps of:

i) contacting preheated feed stock with a mixed catalyst in a first riser reactor under catalytic cracking conditions including catalyst to oil ratio of about 2 to 8, WHSV of about 150–350 $hr^{-1}$, contact period of about 1 to 8 seconds and top temperature in the range of about 400° C. to 500° C., to obtain first cracked hydrocarbon products;

ii) separating the first cracked hydrocarbon products from the first riser reactor into a first fraction comprising hydrocarbons with boiling points less than or equal to about 370° C. and a second fraction comprising hydrocarbons with boiling points greater than or equal to about 370° C., comprising unconverted hydrocarbons;

iii) cracking the second fraction from the first riser reactor comprising hydrocarbons having boiling points greater than or equal to about 370° C., in the presence of regenerated catalyst, in a second riser reactor operating under catalytic cracking conditions including WHSV of about 75–275 $hr^{-1}$, catalyst to oil ratio of about 4–12 and riser top temperature of about 425–525° C. to obtain second cracked hydrocarbon products;

iv) separating the catalytically cracked products from the second riser reactor along with the cracked products comprising hydrocarbons having boiling points less than or equal to about 370° C., from the first riser reactor to yield cracked products comprising dry gas, LPG, gasoline, middle distillates, heavy cycle oil and slurry oil; and v) recycling substantially the entire heavy cycle oil comprising hydrocarbons having boiling points in the range of about 370° C. to 450° C. and at least part of the slurry oil having boiling points greater than or equal to 450° C., into the second riser reactor at a vertically displaced position lower than the position of introduction of the main feed, comprising bottom unconverted hydrocarbon fraction having boiling points greater than or equal to about 370° C., from the first riser reactor to obtain middle distillate products comprising hydrocarbons having carbon atoms in the range of $C_8$ –$C_{24}$ in a proportion of about 50 to 65 wt % of the feed stock.

2. A process as claimed in claim 1 wherein the feed stock is at least one petroleum based heavy feed stock selected from the group consisting of vacuum gas oil (VGO), visbreaker/cooker heavy gas oil, cooker fuel oil and hydrocracker bottom.

3. A process as claimed in claim 1 wherein the feed stock is preheated to a temperature of about 150–350° C. and then injected into a pneumatic flow riser type cracking reactor.

4. A process as claimed in claim 1 further comprising mixing spent catalyst with regenerated catalyst and charging the mixed catalyst, with a coke content of about 0.2 to 0.8 wt % of catalyst, to the bottom of the first riser at a temperature of about 450–575° C.

5. A process as claimed in claim 4 wherein a portion of the spent catalyst from a first stripper and a full portion of the spent catalyst from a second stripper is regenerated in a turbulent or fast fluid ized bed regenerator in the presence of air or oxygen containing gases at a temperature in the range of about 600° C. to 750° C. to obtain the regenerated catalyst with a coke content of less than 0.4 wt %.

6. A process as claimed in claim 5, wherein the catalyst is continuously circulated through standpipe and slide values between the fluidized bed riser reactors, strippers and common regenerator.

7. A process as claimed in claim 1 wherein the cracked hydrocarbon vapor products from the first and second risers are separated from their respective spent catalysts under conditions sufficient to minimize over cracking of middle distillate range products into lighter hydrocarbons.

8. A process as claimed in claim 1 wherein the spent catalysts from the first and second riser reactors are passed through respective dedicated catalyst strippers under conditions sufficient to render the catalysts substantially free from entrained hydrocarbons.

9. A process as claimed in claim 1 wherein the catalytic cracking conditions in the first reactor, including feeding mixed regenerated catalyst, result in very high selectivity of middle distillate range products and conversion of hydrocarbon products of boiling point less then or equal to about 370° C. at lower than about 50 wt % of the fresh feed.

10. A process as claimed in claim 1 wherein the catalyst comprises a mixture of ReUSY zeolite based catalyst, having fresh surface area of 110–810 $m^2$/gm., pore volume of 0.25–0.38 cc/gm and average particle size of 60–70 microns, with selective acidic bottom upgrading components in the range of about 0–10 wt %.

11. A process as claimed in claim 1 wherein unconverted heavy hydrocarbon fraction from the second riser that is recycled into the second riser comprises about 0–50 wt % of the main feed to the second riser.

12. A process as claimed in claim 1 wherein the amount of steam used for feed dispersion and atomization, and catalyst lifting at the riser bottom in the first and the second riser reactors is about 1–20 wt % of the respective total hydrocarbon feed.

13. A process as claimed in claim 1 wherein the spent catalyst resides in a stripper for a period of up to about 30 seconds.

14. A process as claimed in claim 1 wherein regenerated catalyst fed to the bottom of a riser reactor has about 0.1–0.3 wt % coke, has a temperature of about 600–750° C. and is lifted by catalytically inert gases.

15. A process as claimed in claim 1 wherein a Total Cycle Oil (TCO) comprises a mixture of heavy naphtha hydrocarbons having boiling points of about 150° C. to 2.16° C. and light cycle oil hydrocarbons having boiling points of about 216° C. to 370° C.

16. A process as claimed in claim 15 wherein a combined TCO (150–370° C.) product, which comprises a mixture of heavy naphtha (150–216° C.) and light cycle oil (216–370° C.) has a higher cetane number then that from distillate produced in an FCC unit operated in a conventional distillate mode, and has a specific gravity, viscosity and pour point that are in a same range as that of a distillate produced by a conventional FCC unit operating in a distillate mode.

17. A process as claimed in claim 15, which produces a combined TCO product having substantially the same properties, except for a higher cetane number, as that of a TCO obtained from a conventional FCC unit operating in a distillate mode, by:

a) changing a cut point of the TCO from the first riser to 120–370° C., b) processing a 370° C.+ portion of the first riser product in a second riser, and c) changing a cut point of the TCO from the second riser to 120–390° C.

18. A process as claimed in claim 1 further comprising:

(vi) recycling the fraction of unconverted hydrocarbons with boiling points greater than or equal to 370° C., obtained in step (iv) in additional riser reactors by repeating steps (iii) to (iv) to obtain additional middle distillate products.

19. A process as claimed in claim 1 wherein the mixed catalyst comprises spent catalyst and regenerated catalyst and has a coke content of about 0.2 to 0.8 wt % of catalyst.

20. A fluidized bed catalytic cracking system, for the production of high yield of middle distillate products comprising hydrocarbons having carbon atoms in the range of $C_8$ to $C_{24}$ from heavy petroleum feeds, comprising:

A. at least two riser reactors (1 and 2) means to introduce a fresh feed into the first riser reactor (1);

B. mean at the end of the first riser reactor (1), to quickly separate the spent catalyst from hydrocarbon product vapors;

C. means to steam strip said spent catalyst under conditions sufficient to remove entrained hydrocarbons;

D. first conduit means (5), adapted to:

feed a part of the said stripped catalyst into a regenerating apparatus (7), and feed another part of the stripped catalyst into a mixing vessel (10);

E. second conduit means (19) adapted to feed mixed catalyst to a point proximate to the bottom of the first riser reactor (1)

F. third conduit means (12) adapted to feed hydrocarbon product vapors separated from the catalyst evolved from said first riser reactor to a distillation column (13);

G. means to separate first cracked hydrocarbon products into a first fraction comprising hydrocarbons having boiling points not greater than about 370° C. and a second fraction comprising hydrocarbons with boiling points not less than about 370° C., including uncracked feed fractions;

H. fed nozzle means (16) to feed said second fraction, comprising uncracked hydrocarbon products, into the bottom of said second riser reactor (2) at a point above the regenerated catalyst entry zone;

I. means to feed regenerated catalyst from the regenerating apparatus (7) to the bottom of the second riser reactor (2) through a conduit (9);

J. means to separate the hydrocarbon products of the second riser reactor (2) from the spent catalyst;

K. means to separate the cracked products of the second riser reactor (2), along with the products of the first fraction of the first riser reactor (1) comprising hydrocarbons, with boiling points not greater than about 370° C. into fractions comprising dry gas, LPG, gasoline, heavy naphtha, light cycle oil, heavy cycle oil, and slurry oil;

L. means, including a separate feed nozzle (17) located at a point lower than the position of introduction of main feed, to recycle substantially all of the heavy cycle oil and at least part of the slurry oil, comprising hydrocarbons with boiling points of at least about 370° C., to said second riser reactor (2);

M. means to pass the feed and cracked product vapors together with said catalyst, into the second riser;

N. means to separate spent catalyst from product vapors of the second riser reactor (2);

O. means to strip entrained hydrocarbons from spent catalyst;

P. means to conduct stripped catalyst through a conduit (18) into the regenerating apparatus (7);

Q. means to regenerate said stripped catalyst and to produce a hot regenerated catalyst;

R. means to separate said hot regenerated catalyst into two parts, means to pass one part of said hot regenerated catalyst to the mixing vessel (10) through a conduit (8) and means to pass the other part of said hot regenerated catalyst directly to the bottom of the second riser reactor (2);

S. means to pass the mixed catalyst from the mixing vessel (10) through a conduit (19) to the inlet of the first riser reactor (1);

T. means to control:

the catalyst bed level in said stripping means, the catalyst circulation rate from the common regenerator, and the quantity of the spent and regenerated catalyst entering into the mixing vessel (10) using slide valves placed in said conduits; and thereby producing a high yield of middle distillate products.

21. A system as claimed in claim 20 which further comprises a separating device which includes at least one cyclone separator.

22. A system as claimed in claim 20 further comprising means to maintain the pressure in the first and second riser reactors in the range of about 1.0 to 4.0 $kg/cm^2(g)$.

* * * * *